US005234256A

United States Patent [19]

Demircan et al.

[11] Patent Number: 5,234,256

[45] Date of Patent: Aug. 10, 1993

[54] CUTTING APPARATUS FOR MINING OPERATIONS WITH AUTOMATIC CONTROL

[75] Inventors: Bayramali Demircan, Hattingen; Willy Kussel, Werne, both of Fed. Rep. of Germany

[73] Assignee: Tiefenbach GmbH, Essen, Fed. Rep. of Germany

[21] Appl. No.: 828,127

[22] Filed: Jan. 30, 1992

[30] Foreign Application Priority Data

Jan. 31, 1991 [DE] Fed. Rep. of Germany ..... 4102789

[51] Int. Cl.[5] ..... E21D 23/14

[52] U.S. Cl. ..... 299/1.7; 299/32; 405/302

[58] Field of Search ..... 299/1.4, 1.7, 32, 33; 405/302; 91/170 MP

[56] References Cited

U.S. PATENT DOCUMENTS

| | | | |
|---|---|---|---|
| 4,692,067 | 9/1987 | Ward et al. | 91/170 MP X |
| 4,900,091 | 2/1990 | Neu et al. | 299/1.7 |
| 5,029,943 | 7/1991 | Merriman | 299/1.7 X |
| 5,110,187 | 5/1992 | Heintzmann et al. | 405/302 X |

*Primary Examiner*—David J. Bagnell

*Attorney, Agent, or Firm*—Bell, Seltzer, Park & Gibson

[57] ABSTRACT

A cutting machine for mining minerals from a seam thereof, the machine executing reciprocal movements parallel to the face of the seam and being provided with switches for generating signals indicative of the direction of movement of the machine for controlling the removal of protective bumpers on support structures located forwardly of the machine and for moving support structures against the face of the seam and relocating bumpers rearwardly of the machine.

9 Claims, 2 Drawing Sheets

CUTTING APPARATUS FOR MINING OPERATIONS WITH AUTOMATIC CONTROL

BACKGROUND OF THE INVENTION

The invention in general relates to a mining apparatus and, more particularly, to a cutting machine useful for the continuous breaking and removal of coal or other mineral from a subterranean seam thereof.

As a rule, such cutting machines are manually operated, several operators being required to perform such functions as removing bumpers attached to roof support units from the path of the approaching machine, releasing the second and subsequent roof support units behind the cutting machine and, by relaxing a hydraulic cylinder piston arrangement, moving roof support units toward the newly exposed wall of the seam, thereafter raising the roof support units again for bracing or supporting the ceiling, moving the conveyor trough by means of further hydraulic cylinder piston arrangement toward the newly exposed wall of the seam, so that behind the cutting machine, as seen in the direction of its movement, the trough and the tread-like conveyor are moved against the newly exposed seam in a generally S-shaped pattern, and moving the bumpers back into their operative position as soon as possible.

There have been proposals to automate these operations. To accomplish this the roof support units are provided with control devices. The control devices of all the roof support units are, in turn, interconnected with each other, so that any one of the control units may be actuated by any other control unit. In accordance with proposals which have become known, the leading control unit may be actuated by an infrared transmitter or an ultrasonic transmitter or by frequency signals fed through the pull chain or hawser of the machine. Depending upon the location of the transmitter on the cutting machine, the nearest control unit or the one next to it, as seen in the direction of movement of the cutting machine, is actuated for the purpose of withdrawing the forward bumper or bumpers. The control units of the first, second or third roof support structure behind the moving cutting machine, as well as any succeeding control units are actuated by the leading control unit, in order to bring about movement of the roof support structures and of the conveyor toward the mineral seam.

Such known devices have not found wide acceptance in the mining industry, possibly because they are subject to soiling and because of their inherently high potential for error signals. Such error signals may lead to considerable damage to the cutting machine or the support units.

It is an object of the invention to provide a cutting machine control which avoids the disadvantages of prior art machines and which provides for reliable automatic control.

SUMMARY OF THE INVENTION

In accordance with one embodiment of the invention each switching unit comprises paired switching components, including at least one electrical signal transmitter stationarily mounted on the trough adjacent each support unit and a switch member mounted on the cutting machine, the trough-mounted signal transmitter preferably comprising two electrical signal transmitters mounted successively in the direction of movement of the machine, each of the signal transmitters being in turn connected to the control unit affixed to the support unit by means of a shielded or armored cable.

Preferably, the switch means comprises a mechanical switch having two contacts arranged in succession in the direction of movement of the machine.

In another advantageous embodiment, the switch means may comprise a magnetic switch, the magnetic coil of which is mounted on the trough adjacent the associated support unit and being preferably provided with two magnetic coils arranged successively in the direction of movement.

For purposes of automatic operation it is particularly significant that the direction of movement of the cutting machine be recognizable by the leading control device. In accordance with the invention, the switch means comprises two signal transmitters arranged successively in the direction of movement of the machine. The transmitters may be, for instance, electrical contacts or electro-magnetic coils, each control device being capable of evaluating the successively generated signals in such a way that the direction of movement of the cutting machine may be determined, and that on the basis of these signals and appropriate programs, the control units forward and in the rear of the machine may, on the one hand, cause the bumpers to be moved out of the way and, on the other, cause the support units and conveyor to be moved toward the mineral seam.

BRIEF DESCRIPTION OF THE DRAWINGS

An advantageous embodiment of the invention will now be described with reference to the drawings, in which.

DETAILED DESCRIPTION OF THE PREFERRED EMBODIMENT

Figure 1:
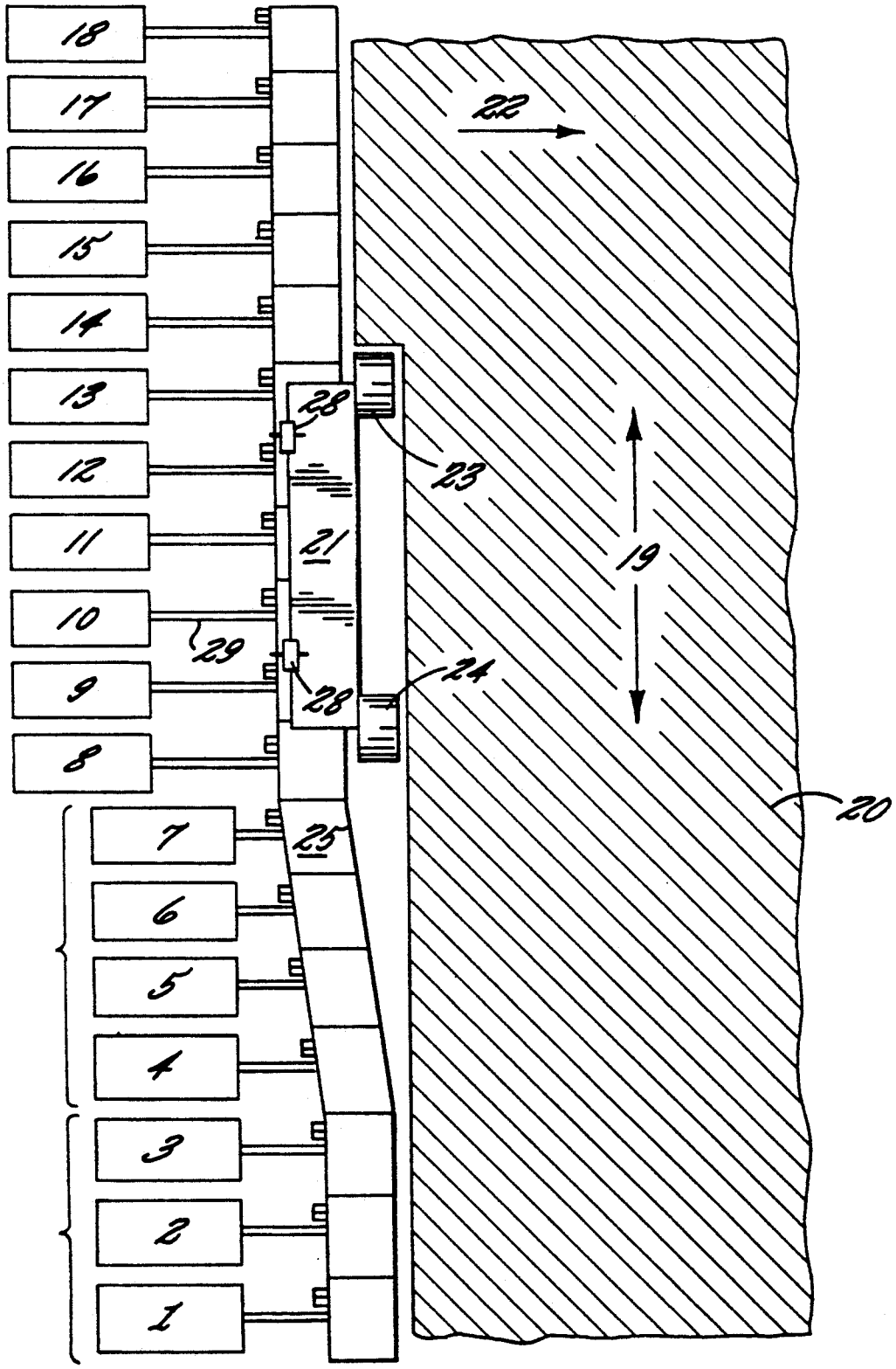
FIG. 1 is a schematic planar view of a cutting machine.

A plurality of support units 1 to 18 are depicted in FIG. 1. These support units are arranged longitudinally and in front of a coal or mineral seam 20. The seam 20 is being removed in the direction 22 by a cutting machine 21 moving reciprocally in the cutting direction 19.

Figure 2:
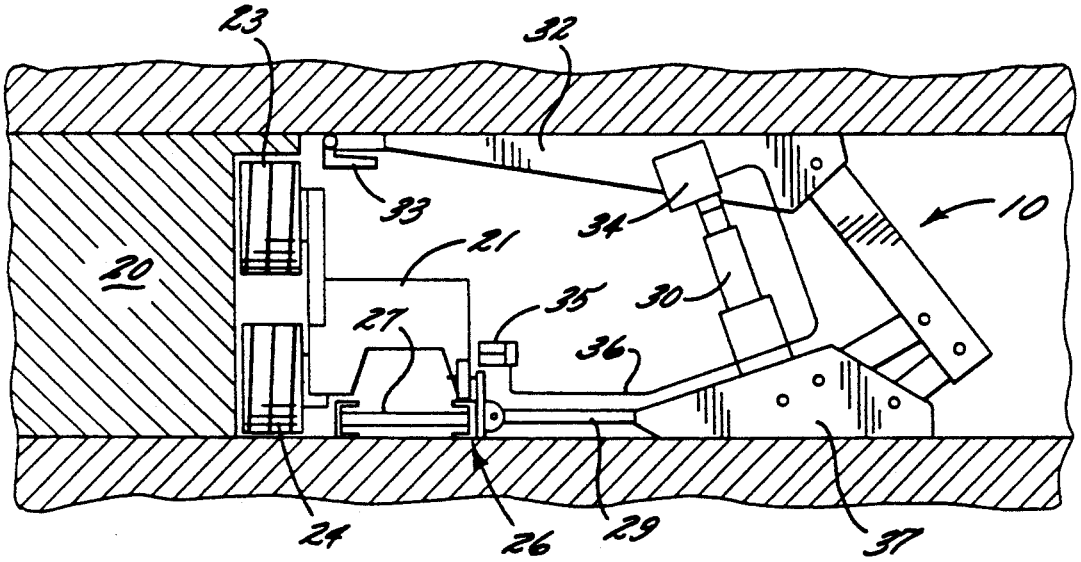
FIG. 2 is a vertical sectional view of the cutting machine.

The cutting machine 21 may be moved in the cutting direction 19 by means of a pull chain or hawser, not shown. The cutting machine may be provided with two cutting drums 23, 24 which may be positioned at different levels and which are used to break and cut the forward face of the coal seam 20. The broaken coal may be deposited on a conveyor 25 by the cutting machine 21. The conveyor 25 may include trough 26 in which a tread-like conveyor 27 may be moved along, i.e. parallel to the face of the seam 20. The cutting machine 21 may be provided with wheels 28 for movement along the front of the seam 20. The trough 26 may be separated into individual units which while connected to each other may nevertheless be moved in the direction of mineral removal 22. Each unit may be connected to a support unit 1 to 18 by means of a piston cylinder unit 29. Every one of the support units 1 to 18 serves to shore up or brace the ceiling of the mine shaft. For this purpose, there may be provided a cylinder piston unit 30 for bracing a bottom plate 31 relative to a roof plate 32. At its forward end pointing toward the seam 20 the roof plate 32 may be provided with a bumper 33. The bumper 33 may be a plate which may be lowered in front of the face of the seam. As shown in FIG. 2, this bumper or apron 33 has to be moved out of the way of the approaching cutting means. This may be accomplished by a cylinder piston unit, not shown.

As shown in FIG. 1, the cutting machine 21 is moving towards the right. This requires moving at least that bumper which is associated with support unit 14 as well as, possibly, the bumper associated with support unit 15, both of these bumpers being positioned forward of the cutting machine 21 as seen in the direction of its movement. On the other hand, the trough 26 of the support unit 7 which is located behind the cutting machine 21 needs to be moved toward the face of the seam 20, and in a similar manner the succeeding support units 6, 5, and 4 are shown to be moved toward the face of the seam 20. The bumpers 33 associated with these support units may again be lowered. The supports unit 3, 2, and 1 have already been moved completely into their new positions and will remain there until such time as the cutting machine 21 is moved toward the left.

For controlling the return movement there is provided on the trough 26 a switch 35 which preferably may be a proximity switch. The switch 35 may comprise two electro-magnets arranged successively in the direction of movement of the cutting machine 21. That is to say, the electro-magnets may be actuated in succession by one of the wheels 28 of the cutting machine 21. In this manner, two signals are generated whenever the cutting machine 21 is approaching the magnets. By means of conduits 36 mounted on the piston cylinder units 29 the signals may be transmitted to control units 34 associated with the respective support units. The control units 34 may be interconnected with each other. When the cutting machine 21 is approaching a control unit 34, such as the one associated with support unit 12 (see FIG. 1) this control unit will receive two signals. The sequence of these signals indicates to this control unit 34 the direction of movement of the cutting machine 21. Accordingly, the control unit 34 generates the signals necessary for withdrawal of the bumpers 33 associated with the support units 14 and 15 and for advancing the support units 7, 6, 5, and 4 behind the cutting machine toward the face of the coal seam.

The control unit 34 may be a pre-programmed processor of the kind well known in the art provided with appropriate memory for generating the signals required as correct responses to the incoming signals.

By means of the switch 35 and the control units associated with each support unit it is possible precisely to define the geometric position, and the direction of movement, of the cutting machine 21 so that the cutting machine may be operated safely and flawlessly.

What is claimed is:

1. A cutting machine for breaking and removing mineral from a seam thereof, comprising:

means reciprocally movable in paths of predetermined length extending substantially in parallel to each other and to the face of said seam, for breaking a layer of predetermined thickness therefrom;

a plurality of support members positioned adjacent each other along at least one of said paths and being movable toward said face, and comprising selectively movable bumper means for supporting individual sections of said face;

means for sequentially generating first and second signals in response to movement of said movable means;

signal processing means responsive to said first and second signals for generating a third signal in response to the sequence of said first and second signals to indicate the direction of said movement and location of said movable means relative to any one of said plurality of support members; and means responsive to said third signal for displacing at least one of said bumper means positioned next adjacent said movable means out of the path of movement thereof.

2. The cutting machine of claim 1, wherein said members are moved individually toward said face by increments substantially equal to the thickness of said layer.

3. The cutting machine of claim 2, wherein said means responsive to said third signal further includes means for moving at least the support member next behind said movable means toward said face.

4. The cutting machine of claim 3, wherein said means responsive to said third signal further comprises means for repositioning said bumper means on said support member next behind said movable means against said face.

5. The cutting machine of claim 4, wherein said support members further include means for conveying said mineral away from said movable means.

6. The cutting machine of claim 5, wherein said conveying means comprises trough means alignable relative to each other in said plurality of support members.

7. The cutting machine of claim 1, wherein said means for generating said first and second signals comprises serially arranged first switch components mounted for movement relative to a complementary second switch component.

8. The cutting machine of claim 7, wherein each of said plurality of support members mounts one of said first switch components.

9. The cutting of machine of claim 8, wherein said first and second switch components comprise electromagnetic switching components.

* * * * *